US012729498B2

(12) United States Patent
De Roo et al.

(10) Patent No.: US 12,729,498 B2
(45) Date of Patent: Sep. 8, 2026

(54) CLAMPING DEVICE FOR A VIBRATING DEVICE FOR INSERTING A FOUNDATION ELEMENT, VIBRATING DEVICE PROVIDED THEREWITH AND METHOD THERE FOR

(71) Applicant: CAPE HOLLAND HOLDING B.V., Beilen (NL)

(72) Inventors: Hendrik Cejus De Roo, Beilen (NL); Laurens De Neef, Beilen (NL)

(73) Assignee: CAPE HOLLAND HOLDING B.V., Beilen (NL)

( * ) Notice: Subject to any disclaimer, the term of this patent is extended or adjusted under 35 U.S.C. 154(b) by 311 days.

(21) Appl. No.: 18/026,513

(22) PCT Filed: Sep. 17, 2021

(86) PCT No.: PCT/NL2021/050562
§ 371 (c)(1),
(2) Date: Mar. 15, 2023

(87) PCT Pub. No.: WO2022/060225
PCT Pub. Date: Mar. 24, 2022

(65) Prior Publication Data

US 2023/0340748 A1 Oct. 26, 2023

(30) Foreign Application Priority Data

Sep. 17, 2020 (NL) ..... 2026490
Apr. 29, 2021 (NL) ..... 2028097

(51) Int. Cl.
*E02D 7/00* (2006.01)
*E02D 7/14* (2006.01)
(Continued)

(52) U.S. Cl.
CPC ..... *E02D 13/00* (2013.01); *E02D 7/14* (2013.01); *E02D 7/18* (2013.01)

(58) Field of Classification Search
CPC .. E02D 13/00; E02D 7/14; E02D 7/18; E02D 7/06; E02D 7/20; E02D 13/06;
(Continued)

(56) References Cited

U.S. PATENT DOCUMENTS 1,787,000 A * 12/1930 Hunt ..... E02D 13/10 173/52
2,328,120 A * 8/1943 Atwater ..... E02D 9/02 173/132
(Continued)

FOREIGN PATENT DOCUMENTS

EP 3059349 A1 * 8/2016 ..... E02D 7/14
FR 2873397 A1 1/2006
(Continued)

OTHER PUBLICATIONS

International Search Report and Written Opinion mailed Mar. 7, 2022, for Application No. PCT/NL2021/050562 (13 pages).

*Primary Examiner* — Edwin J Toledo-Duran
(74) *Attorney, Agent, or Firm* — KDW Firm PLLC

(57) ABSTRACT

A clamping device for a vibrating or hammering device for inserting a foundation element having a flange into the ground, a vibrating or hammering device provided with such clamping device and a method for inserting the foundation element. The clamping device includes a frame, a first clamp body and a second clamp body that are configured to enable a relative movement, and wherein the first and second clamp bodies are provided with respective first and second clamping surfaces that are configured for engaging with respective first and second flange surfaces, a positioning drive for moving the first clamp body relative to the second clamp body in a positioning direction, and a clamping drive for moving the first clamp body relative to the second clamp body to and/or from the flange surfaces in a clamping direction.

20 Claims, 11 Drawing Sheets

(51) Int. Cl.
*E02D 13/00* (2006.01)
*E02D 7/18* (2006.01)

(58) Field of Classification Search
CPC ..... E02D 27/425; E02D 2200/146; E02D 2300/0001; B06B 1/16
See application file for complete search history.

(56) References Cited

U.S. PATENT DOCUMENTS 3,041,839 A * 7/1962 Kupka ..... E02D 7/30 405/247
3,092,414 A * 6/1963 Janoff ..... E02D 9/02 294/102.1
3,136,562 A * 6/1964 Hornstein ..... E02D 13/10 279/43.3
3,227,483 A * 1/1966 Guild ..... E02D 13/10 279/2.13
3,241,326 A * 3/1966 Guild ..... E02D 13/00 173/132
3,391,435 A * 7/1968 Lebelle ..... E02D 13/10 279/4.11
3,530,947 A * 9/1970 Gendron ..... E02D 15/04 405/249
3,686,877 A * 8/1972 Bodin ..... E02D 7/18 405/249
3,721,095 A * 3/1973 Chelminski ..... E02D 13/06 173/1
4,018,290 A * 4/1977 Schmidt ..... E02D 7/18 74/61
4,100,974 A * 7/1978 Pepe ..... E02D 11/00 173/91
4,143,719 A * 3/1979 Furukawa ..... E02D 7/18 173/101
4,645,017 A * 2/1987 Bodine ..... E02D 7/18 173/162.1
4,650,008 A * 3/1987 Simson ..... E02D 7/18 173/91
4,742,468 A 5/1988 Ohashi et al.
5,117,925 A * 6/1992 White ..... E02D 11/00 173/162.1
5,168,938 A * 12/1992 Sano ..... E02D 7/18 173/186
5,355,964 A * 10/1994 White ..... E02D 7/18 173/1
5,609,380 A * 3/1997 White ..... B66C 1/48 294/197
5,653,556 A * 8/1997 White ..... E02D 11/00 175/135
5,823,272 A * 10/1998 van Halteren ..... E02D 7/18 405/249
6,672,805 B1 * 1/2004 White ..... E02D 23/08 175/135
6,691,797 B1 * 2/2004 Hart ..... E02D 11/00 173/128
7,080,958 B1 * 7/2006 Morris ..... E02D 9/02 173/210
7,281,902 B2 * 10/2007 Mortensen ..... F03D 13/10 416/244 R
7,695,217 B2 * 4/2010 Hessels ..... E02D 7/06 173/90
8,186,452 B1 * 5/2012 White ..... E02D 7/18 173/90
8,978,768 B2 * 3/2015 Curry ..... E02D 29/0258 166/338
10,011,970 B2 * 7/2018 DeNeef ..... E02D 7/18
10,584,458 B1 * 3/2020 Butler ..... B23D 47/02
2008/0258032 A1 * 10/2008 Bullivant ..... E02D 7/18 248/562
2011/0081208 A1 * 4/2011 White ..... E02D 23/08 405/249
2011/0243668 A1 * 10/2011 White ..... E02D 7/18 405/249
2011/0311316 A1 * 12/2011 Ditillo ..... E02D 3/12 405/269
2017/0145650 A1 * 5/2017 DeNeef ..... B06B 1/16
2018/0016763 A1 * 1/2018 Kashimoto ..... E02D 1/022
2018/0087232 A1 * 3/2018 Maersch ..... E04H 12/2215
2019/0264412 A1 * 8/2019 Mendler ..... E21B 7/02
2021/0071382 A1 * 3/2021 White ..... F16H 57/0436

FOREIGN PATENT DOCUMENTS

GB 1436805 A 5/1976
WO 2015190919 A2 12/2015

* cited by examiner

CLAMPING DEVICE FOR A VIBRATING DEVICE FOR INSERTING A FOUNDATION ELEMENT, VIBRATING DEVICE PROVIDED THEREWITH AND METHOD THERE FOR

This application is a national stage filing under 35 U.S.C. 371 of pending International Application No. PCT/NL2021/050562, filed Sep. 17, 2021,which claims priority to Netherlands Patent Application No. 2026490, filed Sep. 17, 2020, and also claims priority to Netherlands Patent Application No. 2028097, filed Apr. 29, 2021, the entirety of which applications are incorporated by reference herein.

The invention relates to a clamping device for a vibrating or hammering device suitable for inserting a foundation element into the ground. An example of a foundation element is a foundation pile for a wind turbine. Such foundation elements can be inserted into the ground both on land and at sea.

Known in practice are vibrating or hammering devices for placing a foundation pile on which a construction such as wind turbine can be mounted. To enable vibrating the pile into the ground a so-called vibrator block is usually applied. This requires a correct positioning of the associated vibration block and the foundation pile. In practice this also often involves lifting and/or so-called up-ending of the foundation element.

WO 2015/190919 A2 discloses a vibrating device and method for inserting a foundation element into the ground. This document also illustrates lifting and up-ending of a foundation element with a clamping mechanism that fixedly clamps the foundation element.

The positioning before the actual insertion of the foundation element in the ground requires substantial forces to act on the foundation element, especially during lifting and/or up-ending of the foundation element. This may result in damaging the foundation element, which may include fatigue damage. Also, in case a coating, in particular an offshore coating, is provided to the foundation element there is a substantial risk that lifting and/or up-ending may damage this coating. This may significantly reduce the lifespan of the foundation element.

An object of the present invention is to obviate or reduce one or more of the above mentioned problems.

This object is achieved with the clamping device according to the invention that can be used for a vibrating or hammering device for inserting a foundation element having a flange into the ground. This clamping device comprises:

- a frame;
- a first clamp body and a second clamp body that are configured to enable a relative movement, and wherein the first and second clamp bodies are provided with respective first and second clamping surfaces that are configured for engaging with respective first and second flange surfaces;
- a positioning drive for moving the first clamp body relative to the second clamp body in a positioning direction; and
- a clamping drive for moving the first clamp body relative to the second clamp body to and/or from the flange surfaces in a clamping direction.

The clamping device according to the invention is configured for clamping on a flange of the foundation element. This foundation element may relate to different elements, specifically including a pile, tube, pipe and the like. The foundation element is preferably provided with a flange that is attached to the foundation element at or close to one of its outer ends. This flange has an upper and lower surface as seen in the inserted position of the foundation element.

The clamping device according to the invention is provided with at least a first and second clamp bodies that engage the first and second flange surfaces. This engagement can be direct or indirect using intermediate parts or components.

To enable the clamping device to engage with one of the clamp bodies on a first surface of the flange and with another clamp body on a second surface of the flange a positioning drive is provided. This positioning drive enables a relative movement of the first clamp body to the second clamp body in a positioning direction. This enables (partly) positioning the clamping device below the flange. The positioning drive is further capable of moving the clamp bodies in a desired position such that a clamping movement in a clamping direction can be initiated using the clamping drive. The clamping drive enables a relative movement of the first and second clamp bodies to enable engagement of the clamp bodies on the respective flange surfaces.

The clamp bodies engage the flange in a clamping direction that is substantially transversal to the positioning direction. In the operational position of the foundation element the positioning direction substantially corresponds to a horizontal direction and the clamping direction substantially corresponds to a vertical direction.

Clamping a flange of the foundation element prevents damaging the foundation element itself. Also, in case a coating is provided to the foundation element, the risk of damaging the coating is significantly reduces. Furthermore, the clamping device reduces the fatigue damage of the foundation element. This significantly increases the lifespan of the foundation element.

In addition, the clamping device according to the present invention enables a failsafe operation and failsafe lifting and/or up-ending of the foundation element.

In a presently preferred embodiment the positioning drive and/or clamping drive comprise one or more hydraulic cylinders. It will be understood that other drive systems can also be envisaged in accordance to the present invention.

In a presently preferred embodiment the positioning drive comprises a sliding cylinder.

Providing a sliding cylinder enables a relative movement between the first and second clamp bodies in the positioning direction. This enables positioning of the clamping device relative to the flange of the foundation element and more specifically the correct positioning of the clamp bodies to enable starting the clamping movement. Preferably, the clamp body slides, or is otherwise moved, around the flange to enable a direct clamping of the flange between the clamp bodies. This enables positioning of the vibrating or hammering device relative to the foundation element. Furthermore, it enables lifting and/or up-ending the foundation element.

In a presently preferred embodiment of the invention the clamping drive comprises a two-stage drive system, wherein the first stage enables providing contact between at least one of the clamp bodies and the respective flange surface, and the second stage enables providing a clamping force on the flange.

The clamping drive enables providing the actual direct or indirect engagement of the clamp bodies to the flange, specifically the upper or lower surface thereof. Preferably, the clamping provides a pre-tension and/or clamping force to enable safe operation. As a further effect this pre-tension and/or clamping force reduces variation in tension on the flange. This reduces the risk of damage, including fatigue damage, of the foundation element. In addition, it contributes to a failsafe operation.

Preferably, in one of the embodiments of the invention, the two-stage drive system comprises a hydraulic cylinder having a first chamber configured for moving the first clamp body relative to the second clamp body in the first stage, and a second chamber configured for clamping the flange of the foundation element between the first and second clamp bodies in the second stage and providing a pre-tension. This two-stage drive system enables a step-wise clamping operation wherein the clamping movement and the pre-tensioning are at least partly separated. This preferably enables a design of the first chamber and second chamber that is directed to their specific task. This improves the operation and reduces the risk of damaging the foundation element or flange thereof.

In particular, the first stage has a specific first stroke that is preferably defined by the housing of the clamping device. This enables an effective clamping movement, where after the second stage having a second stroke is designed for optimal pre-tensioning and providing of the desired clamping force.

In one of the presently preferred embodiments of the invention, the first and second chambers are activated separately. In this embodiment, the first chamber is responsible for the clamping movement wherein the clamp bodies move toward each other and engage the flange. Preferably, the movement is such that contact between the clamp bodies and the flange is (just) prevented. The first stage preferably aims at performing a significant part (sub-stroke of first stage) of the stroke of the clamp bodies relative to the flange. The second chamber is responsible for providing the actual clamping force and provides a desired pre-tension. Preferably, the sub-stroke of the second stage is limited to a few mm. In operation, load variation basically only influences the pressure in the second chamber. The first chamber substantially remains at its constant pressure and, therefore, remains its stiffness. Pressure variations are limited to the second chamber. Therefore, variation is restricted to the relatively small volume of the second chamber as compared to conventional systems. This reduces any volume changes in operation as a result of pressure variation. Experiments showed a reduction in the range of 46 to 72% as compared to a conventional system. This provided a higher stiffness over the overall system. This significantly reduces the fatigue damage of the clamping device and the flange. In a presently preferred embodiment, in (vibrating/hammering) operation the pressure in the second chamber is reduced, while the pressure in the first chamber is significantly maintained. This reduces the risk of stretching the frame of the clamping device.

In a presently preferred embodiment the clamping device further comprises a controlled non-return valve to maintain pressure in the first and/or second chamber.

Providing such valve guarantees that during lifting and/or up-ending the clamping of the clamping device on the flange of the foundation element is maintained even in case of a failure of the hydraulic system, for example. This further improves the failsafe system and prevents disconnection of the foundation element from the clamping device. Therefore, this increases the safety when working with a foundation element.

In a presently preferred embodiment the clamping device further comprises a pressure system configured for increasing the clamping force in response to lifting and/or up-ending forces.

In operation, when the actual external forces increase above the pre-tension applied to the clamping device the operational pressure in the cylinder will reduce. In this embodiment this reduction is compensated by providing additional pressure. When the operational forces are removed from the system the increased pressure in the clamping device will remain. This is preferably achieved by using one or more controlled non-return valves, or other suitable means. The advantage hereof is that the operational pressure is partly provided by the lifting and/or up-ending and/or inserting operation(s). This renders the operation very efficient. Also, this enables providing additional pressure in case of oil leakage and/or wear of parts, for example. This further increases the operational safety when working with foundation elements.

In a further preferred embodiment of the invention the clamping device further comprises slide elements configured for connecting the clamping device with a sliding connection to a base frame of the vibrating or hammering device.

Providing slide elements enables to connect the clamping device to a base frame effectively. Preferably, this obviates the need for bolts to connect the clamping device to the base frame. This contributes to a fail-safe system and operation. In addition, the slide elements enable the (rigid) base frame to support the (rigid) stationary part of the clamping device that is preferably provided with the drive cylinder(s). This results in relatively stable operating pressures in the cylinder (s) and/or reduces the fatigue damage of the clamping device and/or pile.

In such embodiment it is presently preferred that the top clamping surface (as seen in a situation of use) of a clamp body is not pushed towards the pile flange when initiating the actual clamping. Instead, the bottom clamping surface of a clamp body is pushed up towards and against the flange bottom. This is initiated by pushing the first and second clamp body up against the base frame. This eliminates negative effects of flexibility of the clamping system, thereby decreasing fatigue damage of the flange significantly.

Preferably, in one of the presently preferred embodiments, the second (sliding) clamp body of the clamping device is operatively connected to the base frame with sliding elements. This provides an effective clamping. More preferably, interaction between one or both clamp bodies and slide elements is configured to enable (at least) one of the clamp bodies to move towards the other clamp body when initiating/starting the clamping action. This interaction provides some play at the clamping end of the clamp body and fixates the other end, thereby enabling a small rotational movement of the clamp body when initiating the clamping. This provides an effective clamping, especially on the inner flange that extends inwardly from the side wall of a foundation element, for example. This provides a significant reduction of the fatigue damage as compared to conventional clamping devices. It was also shown that such small rotational movement of one of the clamp bodies performed better as compared to a pure (vertical) translational movement of the clamp bodies in an alternative embodiment.

In a further preferred embodiment the clamping device comprises a wedge lock in relation to at least one of the clamp bodies.

The wedge lock is preferably provided at a contact surface of the clamp body with the flange surface. The wedge element guarantees a substantially robust contact surface. This provides an additional safeguard. In addition, wear is reduces. Also, the pre-tension can be applied more accurately. The wedge lock is preferably used in combination with the two-stage system.

One of the advantages of providing a wedge lock is that it provides a very stiff and self locking mechanism, which increases the efficiency of the clamp and reduces the fatigue damage.

In a further preferred embodiment of the invention the clamping device further comprises a pile guide configured for guiding the positioning of the clamping device relative to the foundation element.

The pile guide enables a self-aligning effect when positioning the clamping device relative to the foundation element with the flange. This enables an easier positioning of the clamping device relatively to the foundation element.

In a presently preferred embodiment the pile guide, or a number of pile guides, is provided that enables self-aligning of the clamp bodies with the respective flange surfaces in a clamping state of the clamping device.

Preferably, the pile guide is arranged to the frame of the clamping device and/or vibrating/hammering device such that in a clamping state of the clamping device the clamp bodies remain in engagement with the respective flange surfaces. In a presently preferred embodiment this is achieved by arranging the one or more pile guides such that contact between the flange and a clamp bodies is maintained and undesired sliding movement is restricted even in case of a sliding movement of the clamp bodies relative to the flange in a positioning direction. Preferably, the pile guide is arranged such that any retracted clamp body will not be stuck behind the flange when removing the clamping device from the foundation element. This contributes to a failsafe system also in case of a pressure loss during the lifting and/or upending of the foundation element.

Optionally, separate elements can be provided such as a first pile guide for self-alignment and a second pile guide for sliding movement restriction.

In one of the presently preferred embodiments of the invention the pile guide is embodied as a pile guide web construction. This web construction enables connecting individual pile guides together in a construction. Such construction contributes to the overall strength and stability of the system.

In a further preferred embodiment of the invention the pile guide comprises a pile guide contact pad. This contact pad prevents damage to the foundation element during the positioning of the clamping device relative to the foundation element.

In a further preferred embodiment of the invention the clamping device further comprises a pressure relief valve configured to prevent overloading in the operational/driving state of the clamping device wherein the foundation element is inserted into the ground.

Providing a pressure relief valve provides a reduction of unnecessary forces acting on the flange and/or foundation element in a driving state. In one of the presently preferred embodiments this is achieved by reducing the pressure from the second chamber in the two-stage system.

Optionally, strain gauges and/or pressure sensors are provided to monitor the pre-tension during driving in the driving state. This further improves the safety when working with the clamping device.

In a further preferred embodiment the clamping device further comprises a sensor or indicator configured for determining the position of the clamp bodies.

The sensor or indicator detects the relative position of one or more of the clamp bodies to the flange. The sensor may comprise a so-called inductive sensor. In addition or as an alternative the indicator may comprise a so-called visual indicator. In a presently preferred embodiment a combination is applied of both a sensor and an indicator to further improve the safety of working with the clamping device of the invention.

In a further preferred embodiment of the invention at least one of the clamp bodies of the clamping device comprises a contact pad.

The contact pad is preferably a soft pad or soft guide and further reduces the risk of damaging the flange and/or foundation element. This increases the lifespan of the foundation element.

The invention further relates to a vibrating or hammering device for inserting a foundation element into the ground, with the device comprising a clamping device in one of the embodiments of the invention.

The vibrating or hammering device provides the same or similar effects and advantages as described in relation to the clamping device.

In a presently preferred embodiment the vibrating or hammering device comprises two or more clamping devices, such as 4, 6, 8, 12, 16, or 22 clamping devices for an individual foundation element. It will be understood that another number of clamping devices can also be envisaged in relation to of vibrating or hammering device. Optionally, in accordance with a particular embodiment of the invention there can be provided a unitary central clamping device that preferably extends around a substantial part of the circumference of the foundation element.

The invention further also relates to a method for inserting a foundation element into the ground, with the method comprising the steps of:

providing a foundation element with the flange;

providing a vibrating or hammering device with a clamping device in an embodiment of the present invention;

clamping the flange; and inserting the foundation element into the ground.

The method provides the same or similar effects or advantages as mentioned in relation to the clamping device and/or the vibrating or hammering device. Preferably, the clamping is performed on a flange that extends inwardly from a foundation element. The (lower) clamping body is positioned by performing a translational movement. In one of the presently preferred embodiments of the invention, when the clamping is initiated, one of the clamp bodies makes a (small) rotational movement to achieve the actual clamping. It was shown that such small rotational movement of one of the clamp bodies performed better as compared to a pure (vertical) translational movement of the clamp bodies.

In a presently preferred embodiment the method further comprises the step of up-ending the foundation element. This enables an effective operation when inserting a foundation element into the ground.

Further advantages, features and details of the invention are elucidated on the basis of preferred embodiments thereof, wherein reference is made to the accompanying drawings, in which.

Figure 3:
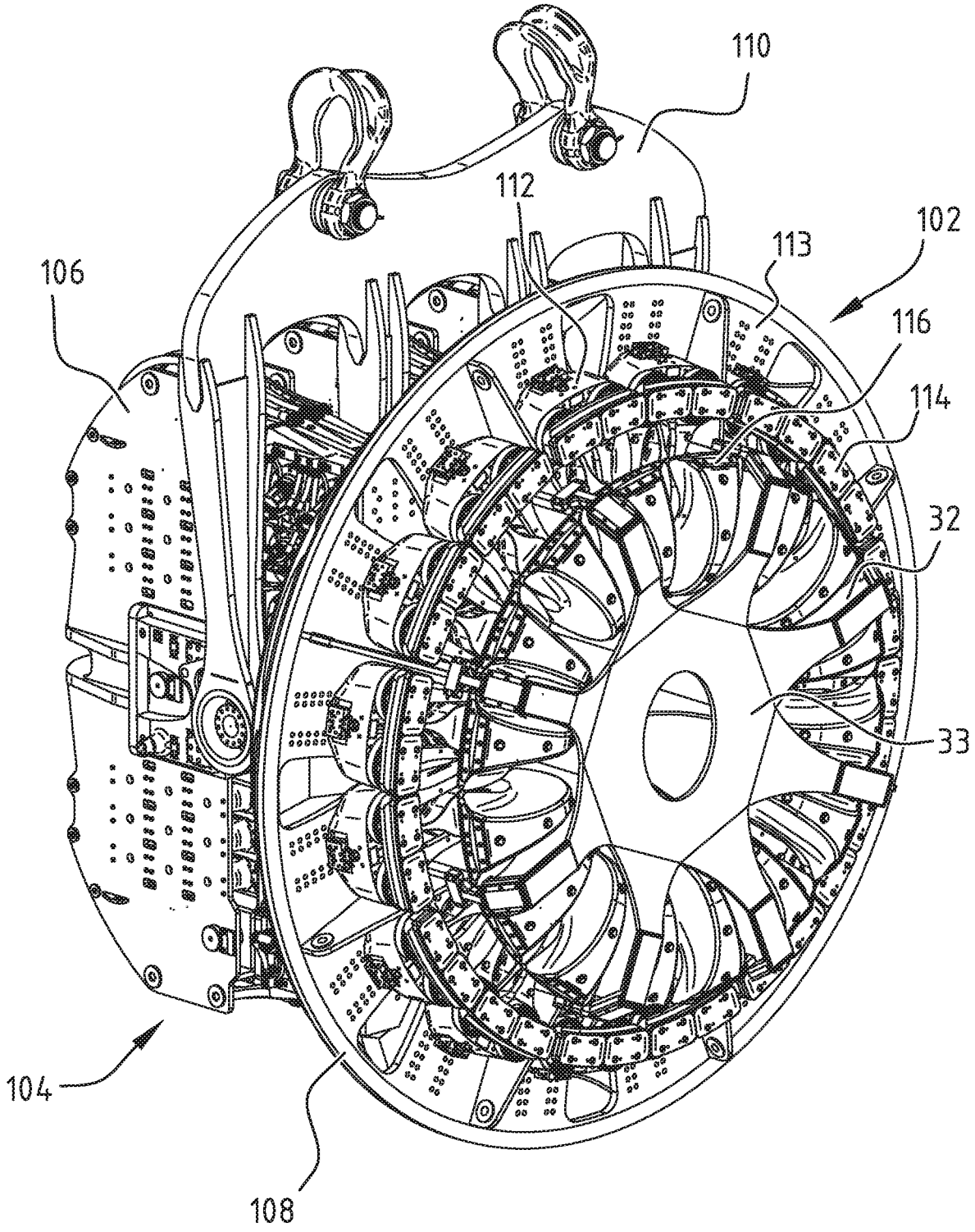
FIG. 3 shows a vibrating device provided with a number of alternative clamping devices of FIGS. 2A-C according to the invention.
Figure 5B:
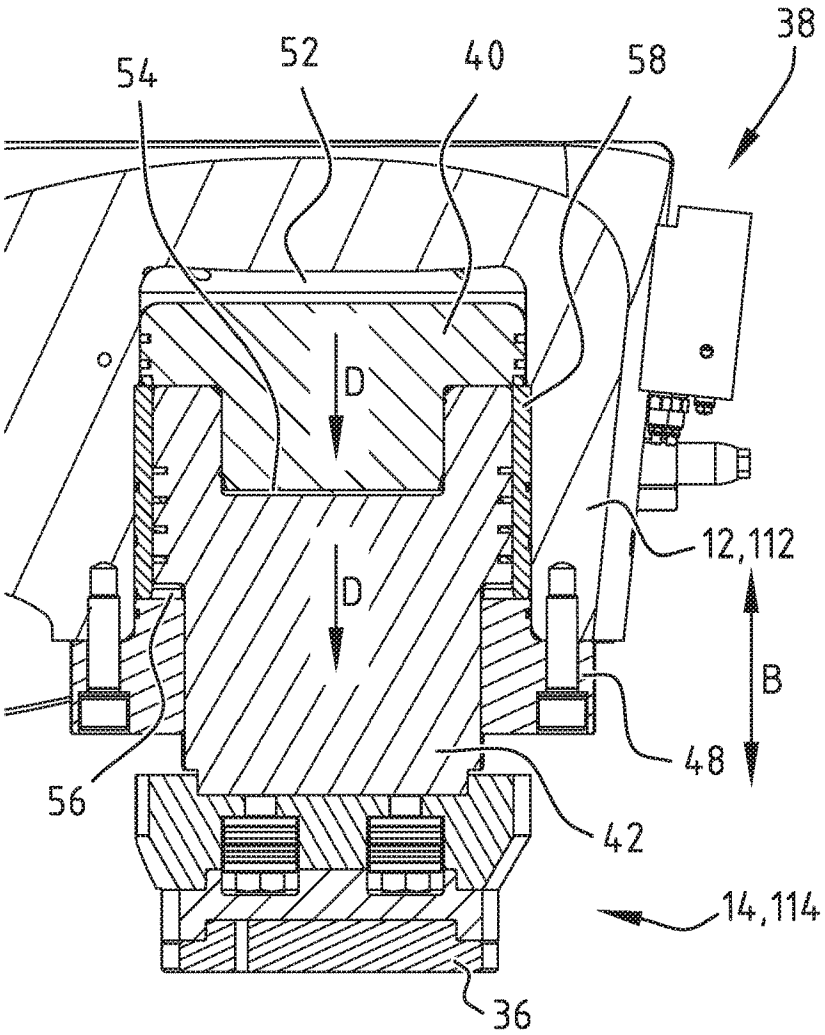
Figure 5A:
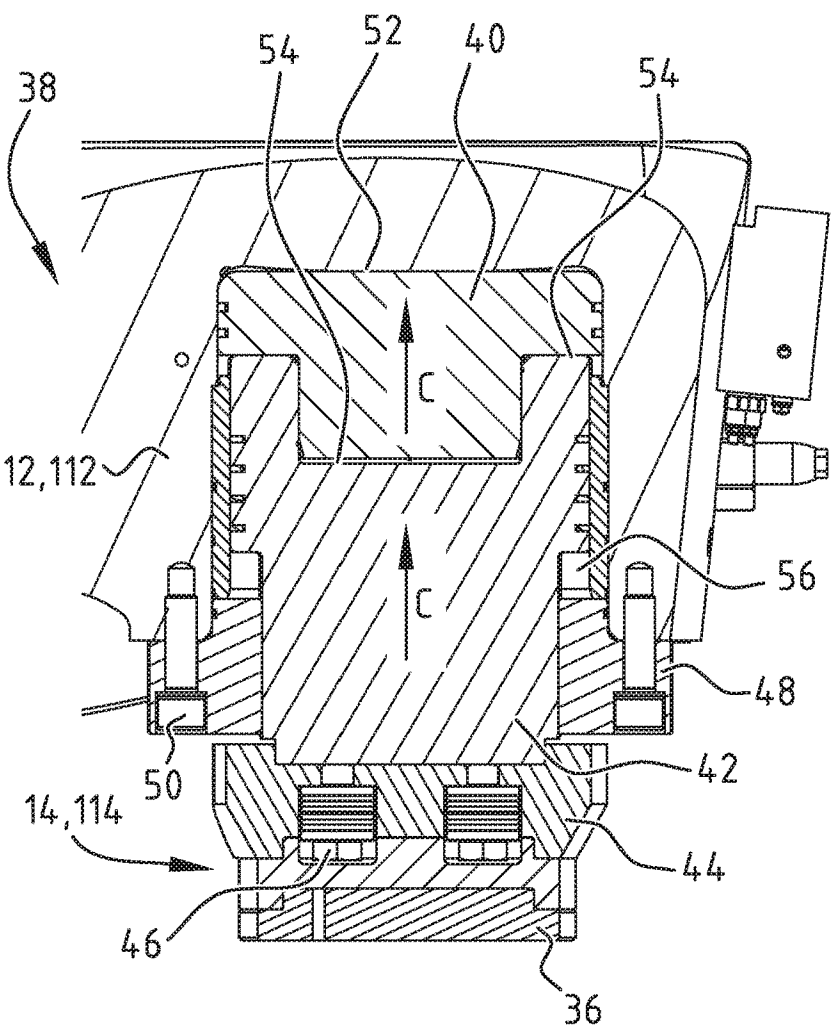
Figure 5D:
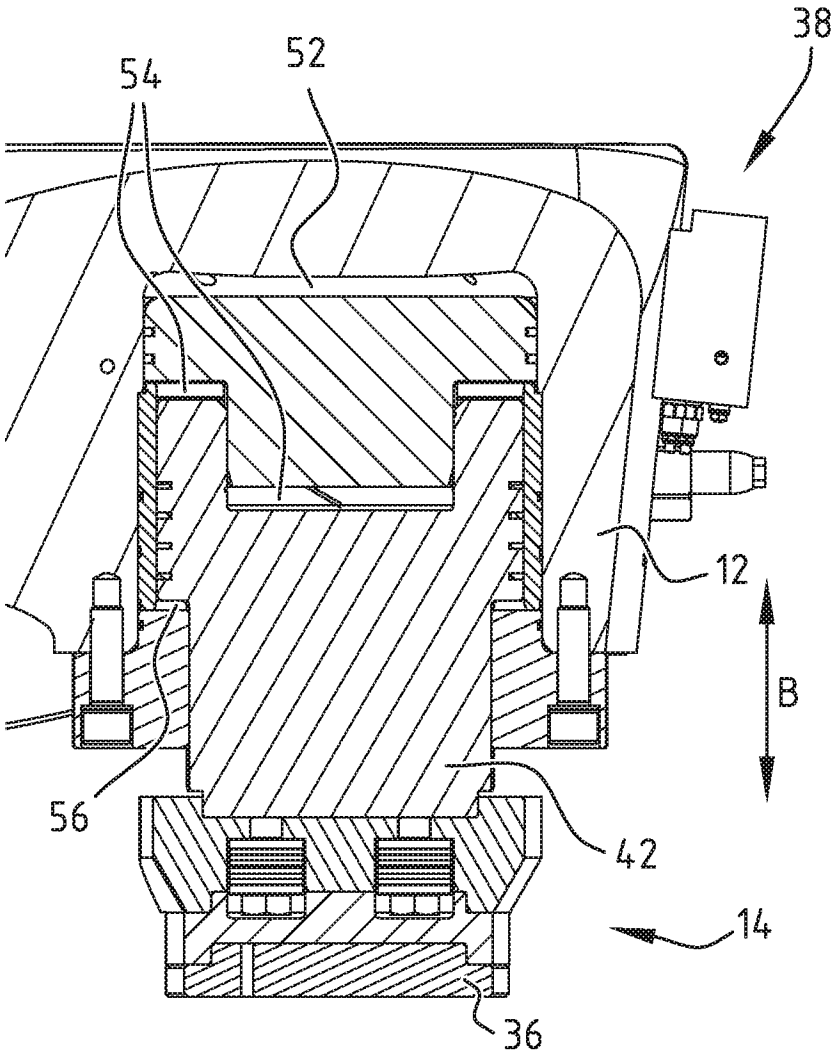
Figure 5C:
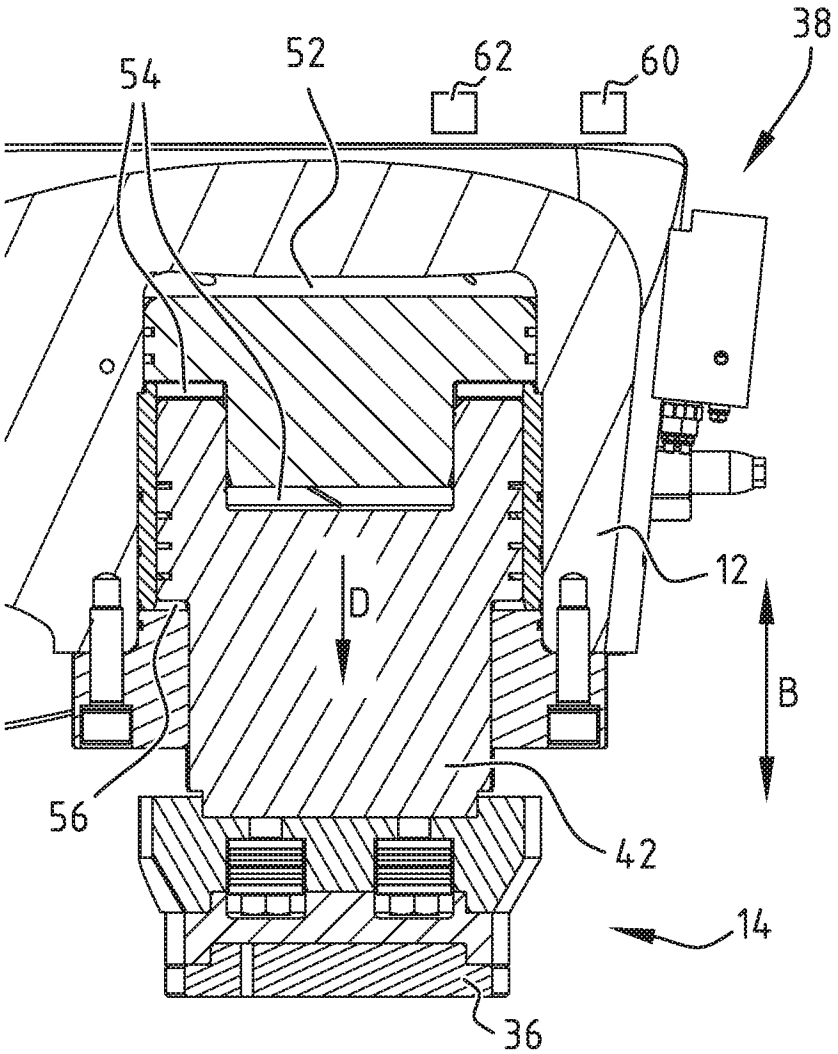
Figure 6:
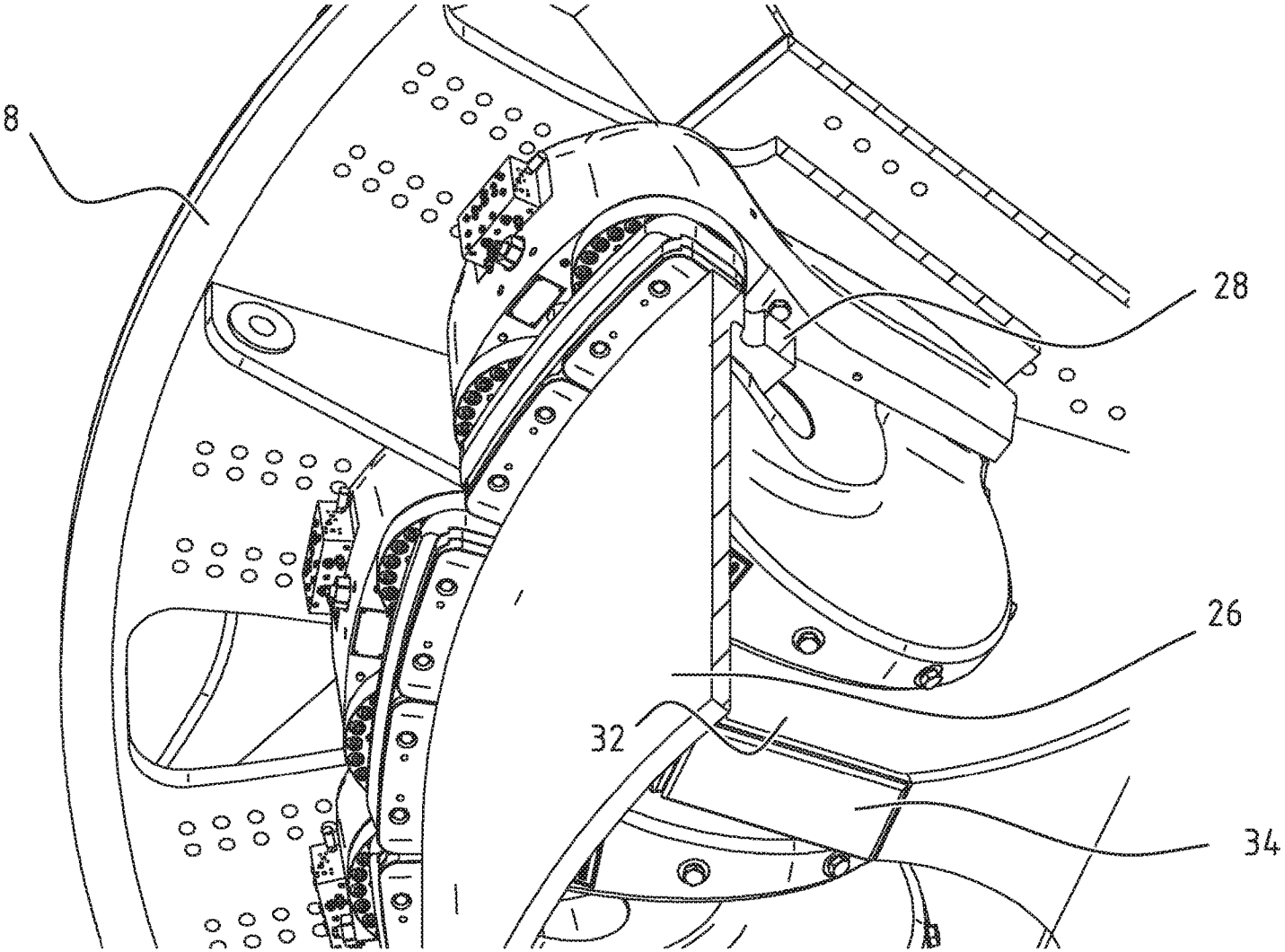
Figure 7:
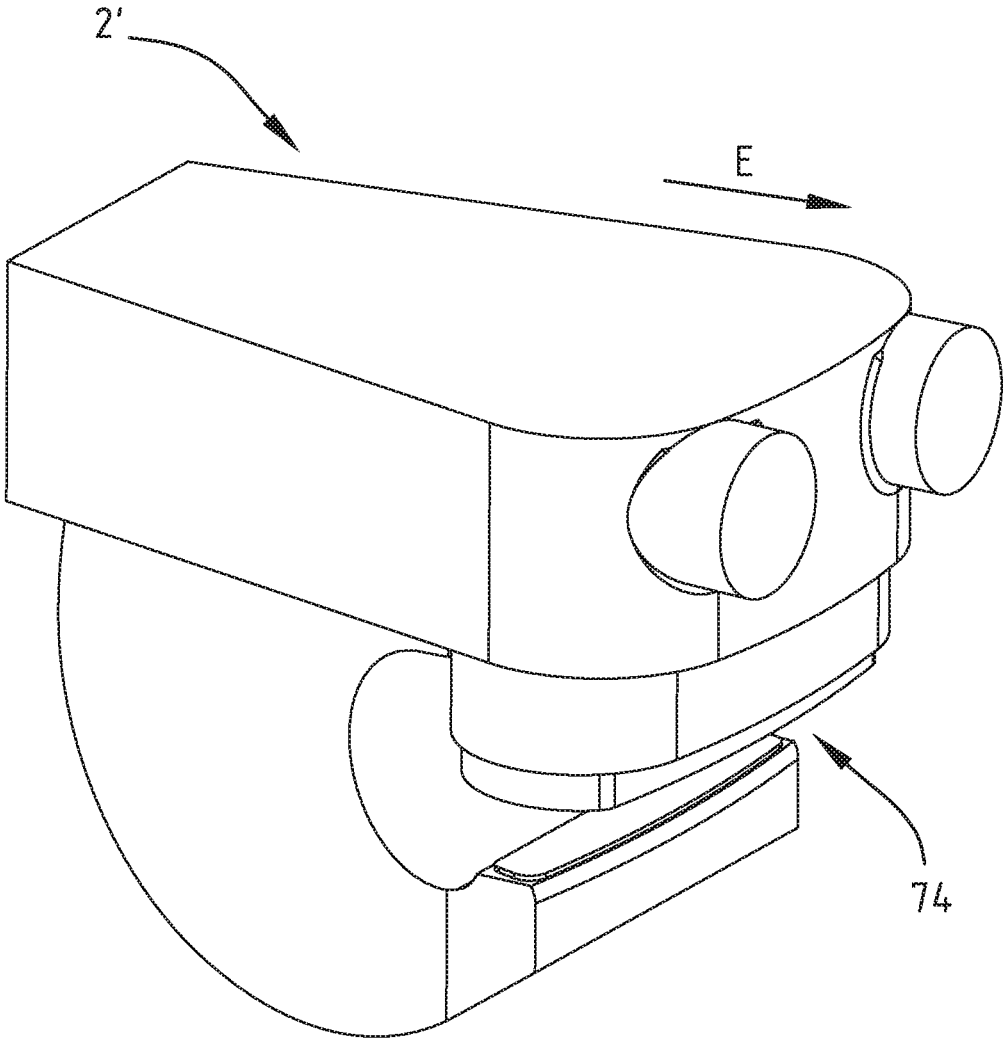

FIG. 5A discloses the two-stage drive system in a presently preferred embodiment of the invention with the clamp in an open state;

FIG. 5B shows the system of FIG. 5A when the clamp is closed;

FIG. 5C shows the system of FIG. 5A when pre-tension is applied;

FIG. 5D shows the system of FIG. 5A with pressure reduction when in operation;

FIG. 6 shows the clamping device of FIG. 3 and vibrator block in an operational state; and FIG. 7 shows an embodiment of the clamping device with a wedge block.

Clamping device 2' (FIG. 1) is used for vibrating or hammering device 4 comprising vibrator block 6 that is connected to base frame 8. In the illustrated embodiment vibrator block 6 is provided with hoist 10 to enable lifting and/or up-ending Clamping device 2' is provided with frame 12, first clamp body 14 and second clamp body 16.

Figure 1:
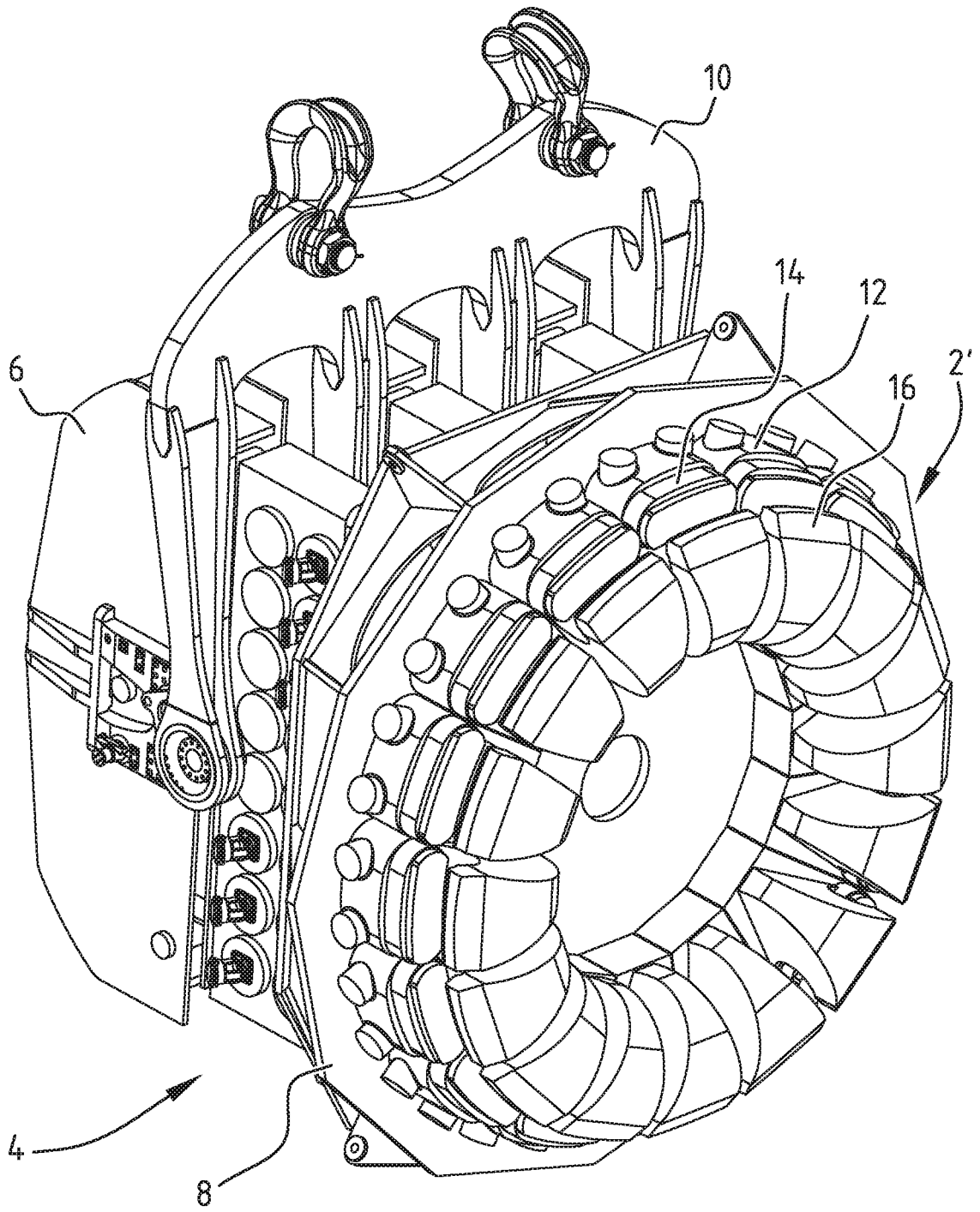
FIG. 1 shows a vibrating device provided with a number of clamping devices in an embodiment of FIG. 7 according to the invention.

In the illustrated embodiment vibrating or hammering device 4 is provided with 16 clamping devices 2' (FIG. 1). It will be understood that another number of clamping devices 2 can also be envisaged in accordance to the present invention. Top 13 of frame 12 is connected to base frame 8, preferably with a number of bolts.

Figure 2A:
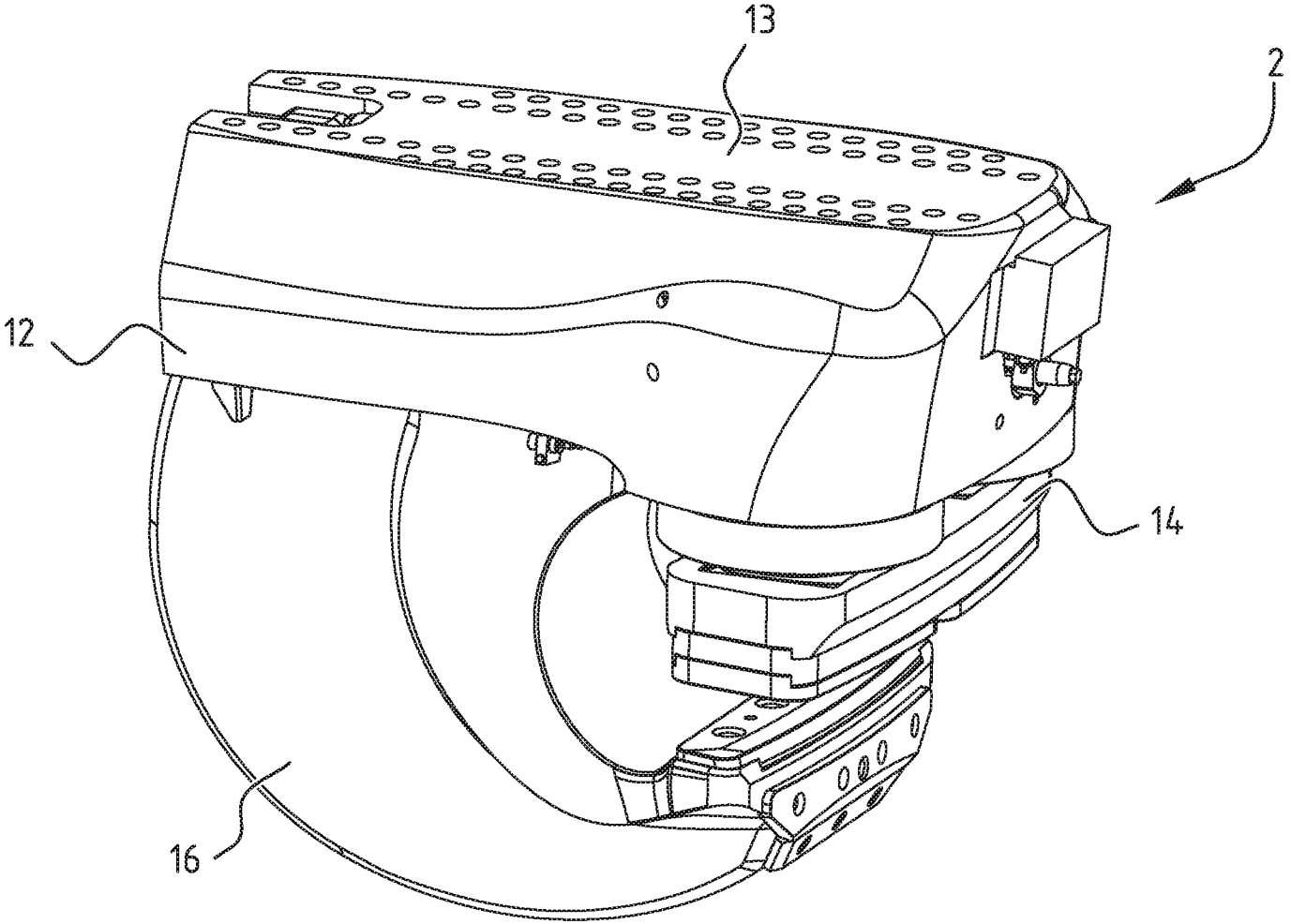
FIG. 2A shows an alternative clamping device according to the present invention.
Figure 2B:
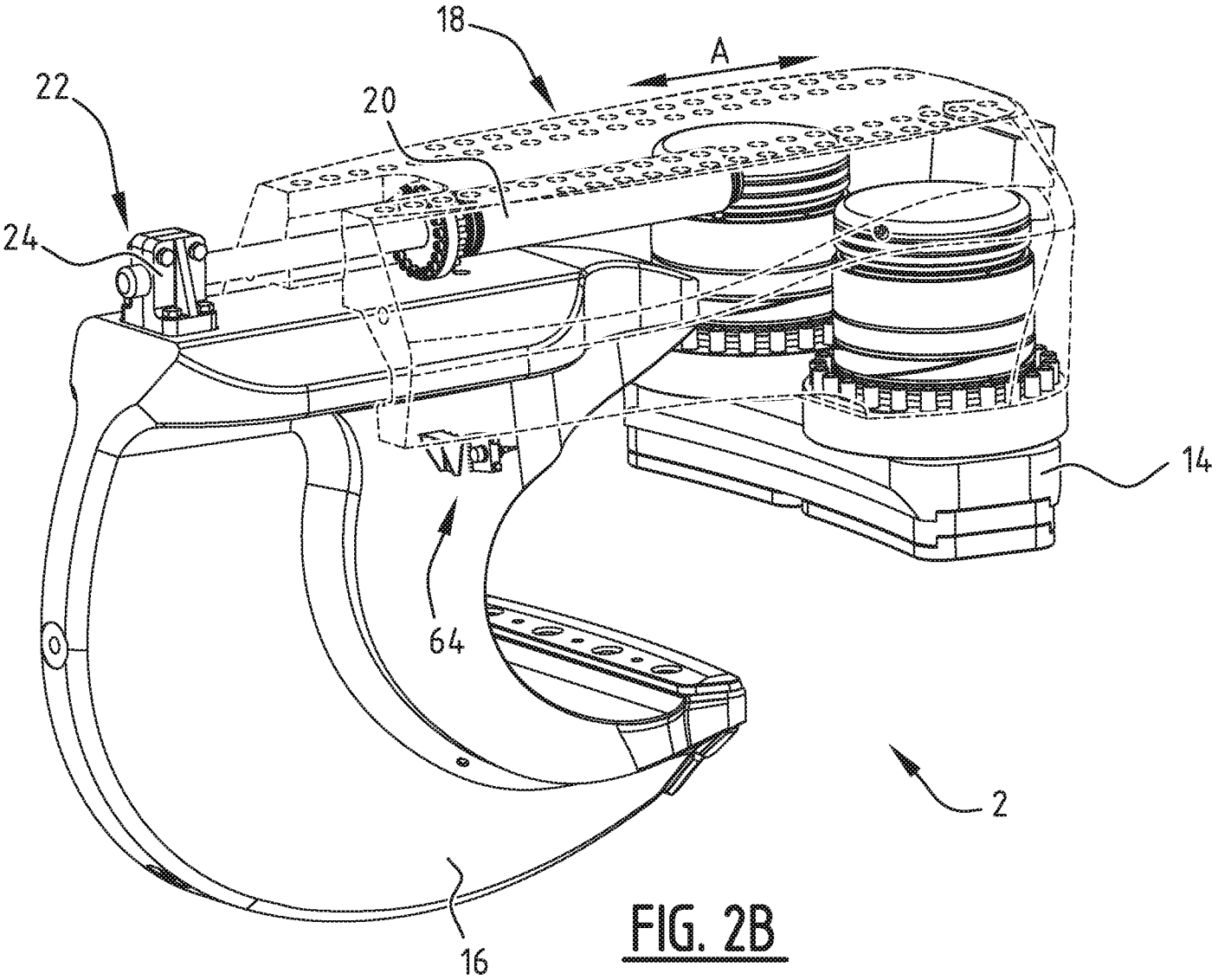
FIG. 2B shows the clamping device of FIG. 2A when being prepared for stabbing.

Clamping device 2 (FIG. 2A-C) comprises positioning drive 18 with cylinder 20 that is on one end 22 connected to second clamp body 16 with connection 24. Clamping device 2 has similar components as shown in relation to the alternative clamping device 2' (FIG. 1). Cylinder 20 (FIG. 2B) enables movement in positioning direction A. This enables positioning clamping device 2 around a flange of a foundation element and thereafter (re)positioning second clamp body 16 relative to first clamp body 14 in positioning direction A.

In an illustrated alternative embodiment clamping device 102 (FIG. 3) is used for vibrating or hammering device 104 comprising vibrator block 106 that is connected to base frame 108. In the illustrated embodiment clamping device 102 preferably corresponds to clamping device 2. Also in this illustrated embodiment vibrator block 106 is provided with hoist 110 to enable lifting and/or up-ending. Clamping device 102 is provided with frame 112, first clamp body 114 and second clamp body 116. In this embodiment clamping device 102 is fitted in recess 111 that is provided in carrier 113 of base frame 108. Recess 111 is provided with maneuvering space $A_1$ that allows second clamp body 116 to move in direction A relative to first clamp body 114.

Figure 4A:
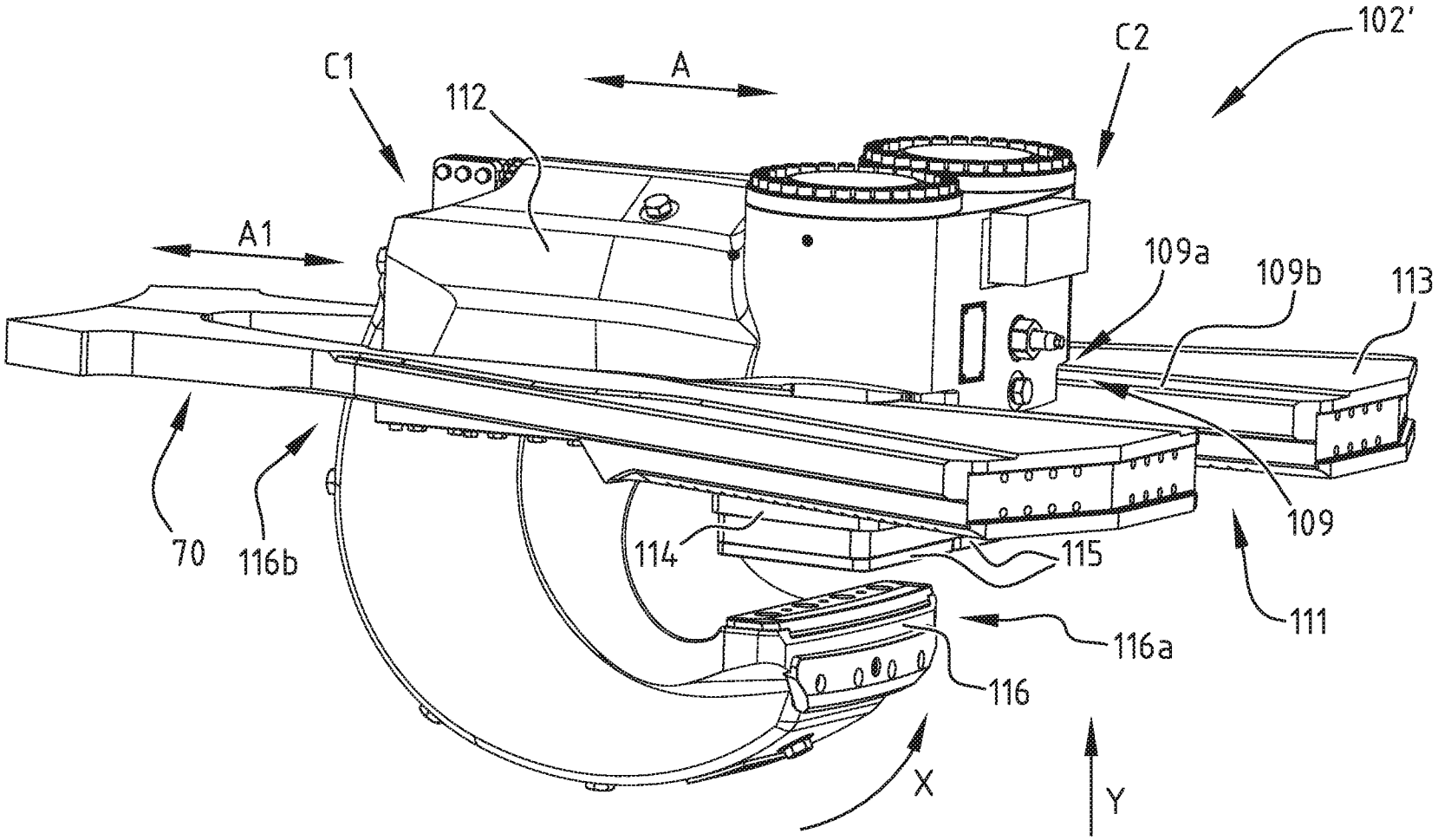
FIG. 4A shows details of a further alternative clamping device according to the invention.

In one of the presently preferred and illustrated embodiments clamping device 102' is provided with slide elements 109 (FIG. 4A). In the illustrated embodiment slide elements 109 comprise slide recess 109*a* that is provided in frame 112 of clamping device 102 and sliding guide 109*b* that is provided in or on carrier 113. It will be understood that other slide elements can also be configured according to the invention. First clamp body 114 is provided with two clamp pads 115. It will be understood that another number of pads could also be envisaged according to the invention, such as one, three, four et cetera.

Clamping device 102' (FIG. 4A) is provided with the same or similar components as illustrated in relation to clamping device 2, 2', 102 in relation to steering and controlling the movement of second clamp body 116 relative to first clamp body 114 in positioning direction A.

Clamping device 102' (FIG. 4A) enables movement of clamp body 116 in direction A, $A_1$. In the illustrated embodiment the interaction between clamp body 116 and slide elements 109, 109*a* is configured to enable clamp body 116 to move towards clamp body 114 when initiating/starting the clamping action. In this illustrated embodiment the interaction is such that clamp body 116 makes a rotational movement X towards clamp body 114. In this illustrated embodiment this is enabled by the interaction allowing no or minimal movement $C_1$ in direction Y (transversal to the plane of carrier 113 of base frame 108) at or near end 116*b* of the moving clamp body 116, while providing some play $C_2$ such that clamp body at clamping end 116*a* enables the aforementioned rotational movement in direction X. So, clamp body 116 is capable of translating in direction A for positioning and rotating in direction X for clamping a flange in direction Y. It will be understood that other configurations can also be envisaged in accordance with the invention.

Foundation element 26 (FIGS. 4B, 6) is provided with flange 28. Clamping device 2, 2', 102, 102' is configured for clamping around flange 28 using first clamp body 14, 114 and second clamp body 16, 116. In the illustrated embodiment clamping device 2, 2', 102, 102' is brought in opening 30 (see also FIGS. 4C, 6) at one end of foundation element 26. Pile guide 32 (see also FIGS. 3, 4C, 6) is provided to guide the positioning of clamping device 2, 2', 102, 102' relative to foundation element 26. Pile guide 32 is optionally provided with one or more pile guide contact pads 34 to minimize the risk of damaging flange 28 and/or foundation element 26.

In operation, pile guide 32 is arranged to frame 8, 108 such that in a clamping state of clamping device 2, 2', 102, 102' clamp bodies 14, 16, 114, 116 remain in engagement with respect of the flange surfaces. This provides additional safety. Optionally, pile guides 32 are part of pile guide web structure 33 (FIG. 3) that adds to the overall stability and strength of frame 8, 108.

Figure 2C:
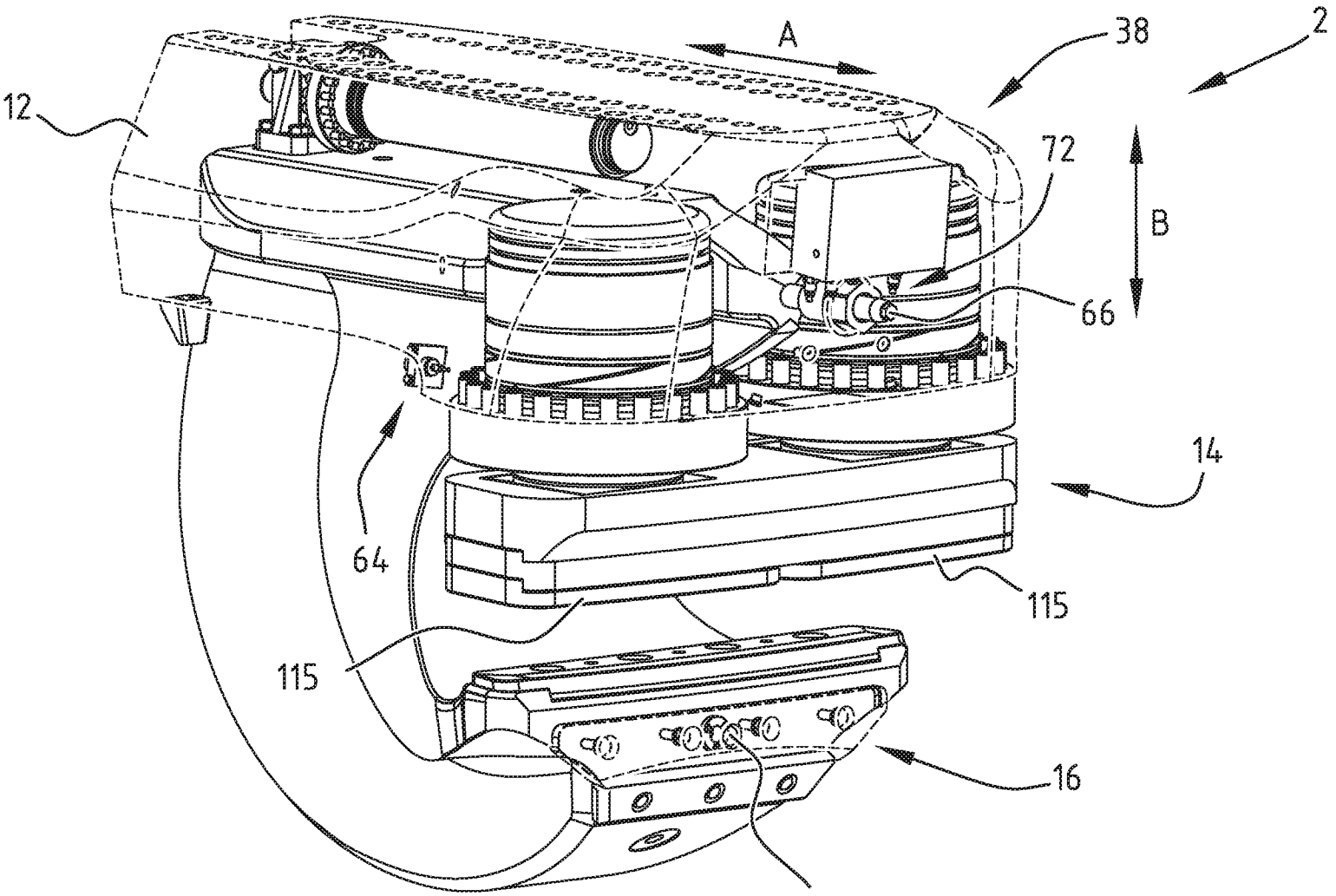
FIG. 2C shows further details of the clamping device of FIGS. 2A-B.
Figure 4B:
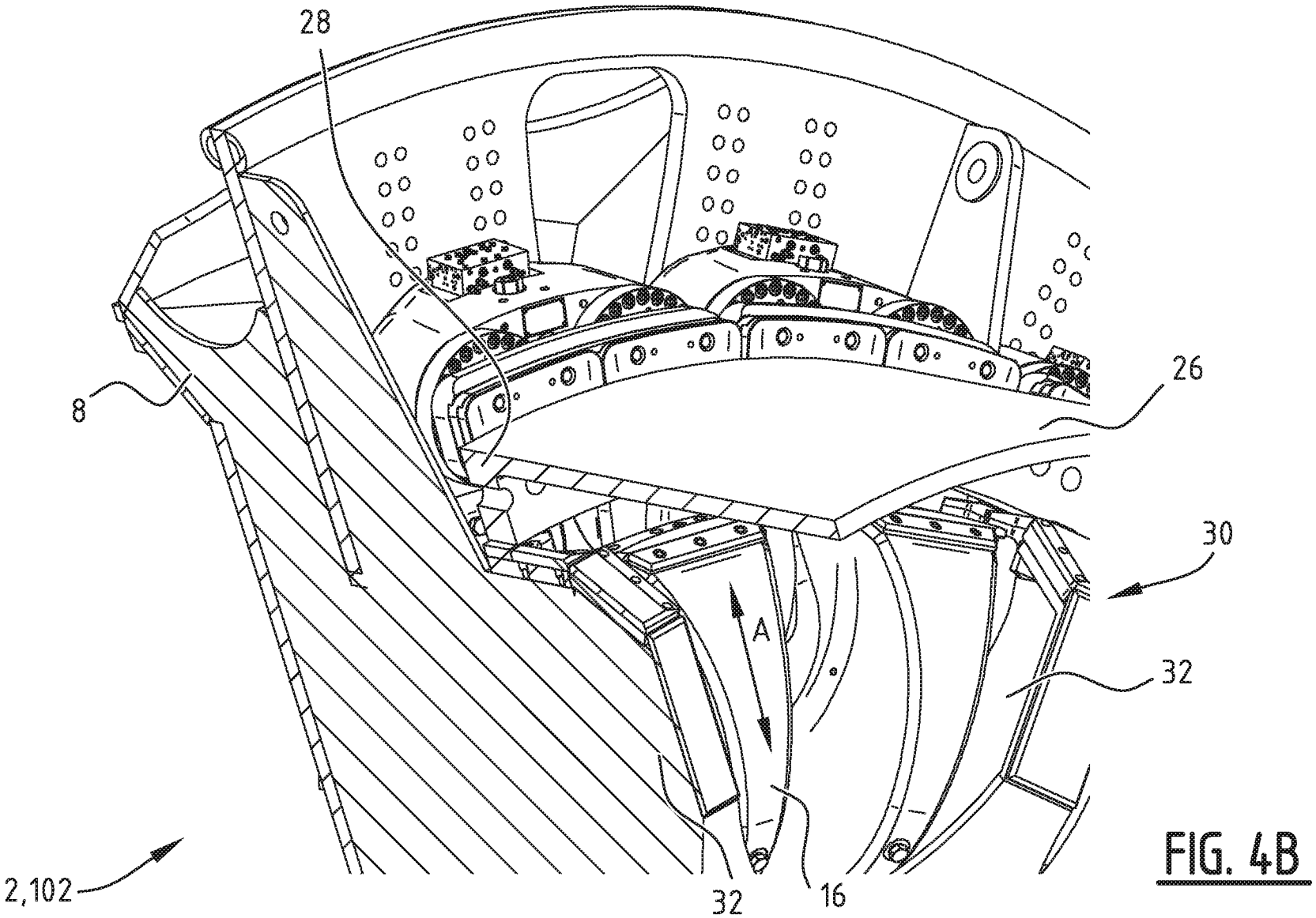
FIG. 4B shows details of the clamping device of FIGS. 2A-C.

After being positioned inside opening 30 of foundation element 26 second clamp body 16, 116 is moved in direction A relative to first clamping body 14, 114 (FIGS. 4A-B, 2C). In the illustrated embodiment this movement is achieved with cylinder 20. Clamp bodies 14, 16, 114, 116 are preferably provided with separate contact pads 36 (e.g. see FIG. 5A) that provide a contact surface between clamp bodies 14, 16, 114, 116 and flange 28 of foundation element 26. After the sliding movement in direction A, a clamping movement in clamping direction B with clamping drive 38 is provided. In the illustrated embodiment clamping direction B is substantially transversal to positioning direction A. In the illustrated embodiments clamping direction B corresponds to direction Y (FIG. 4A).

Clamping drive 38 is illustrated as a two-stage system (FIGS. 5A-D). It will be understood that another configuration for clamping drive 38 can also be envisaged in accordance to the present invention. In the illustrated embodiment system 38 comprises first block 40, second block 42, clamp element 44 and optionally a number of contact pads 36. Clamp element 44 is connected with bolts 46 to second block 42. Guide block 48 is connected with bolts 50 to frame 12, 112. Clamping drive 38 with the two-stage system further comprises first chamber 52, second chamber 54 and third chamber 56.

In an open position of clamping device 2 (FIG. 5A) first element 40 and second element 42 move in opening direction C substantially parallel to clamping direction B. First and second chambers 52, 54 are brought at a low pressure, and third chamber 56 is provided with a higher pressure to enable movement in direction C. In the illustrated embodiment the pressure in third chamber 56 can be about 320 bar in this stage of the operation.

In a closing position (FIG. 5B) first chamber 52 is brought at pressure, for example about 320 bar. Second and third chambers 54, 56 are provided at low or zero pressure to enable movement of first element 40 and second element 42 in closing direction D. In the illustrated embodiment movement in direction D continues until first element 14, 114 engages contact surface 58 of guiding element 48. In this position clamping device 2, 102 is closed.

To provide a clamping force on flange 28, second chamber 54 is put under pressure, for example the same pressure of 320 bar. Pressurizing second chamber 54 enables movement of second element 42 in direction D parallel to clamping direction B.

It is noted that in the illustrated embodiment pressure is maintained in chambers 52, 54, 56 by providing a controlled return valve 60 controlled by control 62 (schematically illustrated in FIG. 5C). In this pre-tensioning stage foundation element 26 can be lifted and/or up-ended.

It will be understood that other working pressures can also be envisaged in accordance to the present invention, optionally including different pressures in different stages in the chambers of clamping device 2, 102.

Optionally, when in operation (e.g. see FIG. 6), clamping forces can be reduced to improve the lifespan of flange 28 and/or foundation element 26. This can be achieved by reducing pressure in second chamber 54, for example to about 50 bar. It will be understood that another pressure can also be envisaged in accordance to the present invention. In this situation first chamber 52 is maintained at a relatively high pressure, for example 320 bar and third chamber 54 is maintained at a low pressure. Due to the external load when inserting foundation element 26 into the ground the actual operational pressure in second chamber 54 will vary in time, typically between 50 bar and 400 bar.

Optionally, inductive sensor 64 (FIG. 2B, 2C) is provided for positive confirmation of a retracted position of clamp bodies 14, 16, 114, 116. It will be understood that another sensor or combination of different sensors can also be envisaged in accordance to the present invention to the different embodiments of clamping device 2, 102.

A further optional feature is visual indicator 66 and/or another inductive sensor 68 (FIG. 2C) that are configured for confirmation that the sidewall of foundation element 26 is engaged. Optionally, clamping drive 38 is activated after positive feedback from one or more of the sensors (FIG. 2C). It will be understood that another sensor or combination of different sensors can also be envisaged in combination with drive 18, 38 in accordance to the present invention in relation to the different embodiments of clamping device 2, 2', 102, 102'.

Also, base frame 8, 108 is optionally provided with safeguarding elements 70 that maintain clamp bodies 14, 16, 114, 116 in place in case of pressure loss (FIG. 3). No pre-tension force for clamping force is lost.

Manifold 72 (FIG. 2C) is provided with balancing valves for positioning cylinder 20 to prevent overloading by any up-ending force and to hold clamp bodies 14, 16, 114, 116 in the relative position even also in case of a pressure loss. Optionally, return valve 60 can be provided in manifold 72. Also optionally, additional strain gauges and/or pressure sensors can be provided to monitor the clamping force, for example during operation such that controller 62 may adjust pressures in any of the chambers 52, 54, 56 and/or valves, such as return valve 60. In the illustrated embodiments manifold 72 is also provided so-called flush valves to remove pressure and/or forces. It will be understood that manifold 72 can be applied to the different embodiments of clamping device 2, 102.

In one of the embodiments clamping device 2' (FIG. 7) is provided with additional wedge 74. In this embodiment first chamber 52' is put at the operating pressure. Wedge 74 is moved in direction E above cylinder with a slightly higher pressure such that wedge 74 transfers a relatively small force. During vibrating/hammering the pressures can be reduced as the pre-tension remains due to the mechanical securement of the wedge. When releasing clamp bodies 14', 16' from the flange first chamber 52' and the pressure of wedge 74 are reduced such that the pre-tension on wedge 74 is reduced, thereby enabling a relatively easy removal of wedge 74. Unlocking chamber 76 is put at pressure to enable retraction of the cylinder and opening of the clamping device 2'.

The invention is by no means limited to the above described preferred embodiments thereof. The rights sought are defined by the following claims, within the scope of which many modifications can be envisaged. For example, features of the different illustrated embodiments can be applied to the other embodiments, such as the wedge, two-stage system, enabling a rotational movement for one the clamp bodies when initiating the clamping et cetera.

The invention claimed is:

1. A clamping device for a vibrating or hammering device for inserting a foundation element having a flange into the ground, the clamping device comprising:

a frame;

a first clamp body and a second clamp body configured to enable a relative movement therebetween, wherein the first and second clamp bodies directly oppose each other, and wherein the first and second clamp bodies are provided with respective first and second clamping surfaces that are configured for engaging with respective first and second flange surfaces positioned between the directly opposing first and second clamp bodies;

a positioning drive for moving the first clamp body relative to the second clamp body in a positioning direction;

a clamping drive for moving the first clamp body relative to the second clamp body to and/or from the first and second flange surfaces in a clamping direction; and a pressure relief valve coupled to the clamping drive configured to prevent overloading of the clamping drive in a driving state when the foundation element is inserted into the ground;

wherein the first and second clamp bodies engage the first and second flange surfaces in the clamping direction, wherein the clamping direction is substantially transverse to the positioning direction, wherein in an operational position of the foundation element the positioning direction substantially corresponds to a horizontal direction, and wherein the clamping direction substantially corresponds to a vertical direction.

2. The clamping device according to claim 1, wherein the positioning drive comprises a sliding cylinder.

3. The clamping device according to claim 1, wherein the clamping drive comprises a two stage drive system, wherein the first stage provides contact between at least one of the clamp bodies and the respective flange surface, and the second stage provides a clamping force on the flange.

4. The clamping device according to claim 3, wherein the two stage drive system comprises a hydraulic cylinder having a first chamber configured for moving the first clamp body relative to the second clamp body in the first stage, and a second chamber configured for clamping the flange of the foundation element between the first and second clamp bodies in the second stage.

5. The clamping device according to claim 4, further comprising a controlled non-return valve to maintain pressure in the first and/or second chamber.

6. The clamping device according to claim 1, further comprising a pressure system configured for increasing the clamping force in response to lifting and/or up-ending forces.

7. The clamping device according to claim 1, further comprising slide elements configured for connecting the clamping device with a sliding connection to a base frame of the vibrating or hammering device.

8. The clamping device according to claim 7, wherein the sliding connection is configured to enable the clamp body to make a rotational movement when initiating the clamping.

9. The clamping device according to claim 1, wherein at least one of the clamp bodies is provided with a wedge lock.

10. The clamping device according to claim 1, further comprising a pile guide configured for guiding the positioning of the clamping device relative to the foundation element.

11. The clamping device according to claim 10, wherein the pile guide is arranged to the frame such that in a clamping state of the clamping device the clamp bodies remain in engagement with the respective flange surfaces.

12. The clamping device according to claim 10, wherein the pile guide comprises a pile guide contact pad.

13. The clamping device according to claim 1, further comprising a sensor or indicator configured for determining the position of the clamp bodies.

14. The clamping device according to claim 1, wherein at least one of the clamp bodies comprises a contact pad.

15. A vibrating or hammering device for inserting a foundation element into the ground, comprising the clamping device according to claim 1.

16. The vibrating or hammering device according to claim 15, further comprising two or more clamping devices.

17. The clamping device according to claim 2, wherein the clamping drive comprises a two stage drive system, wherein the first stage provides contact between at least one of the clamp bodies and the respective flange surface, and the second stage provides a clamping force on the flange, wherein the two stage drive system comprises a hydraulic cylinder having a first chamber configured for moving the first clamp body relative to the second clamp body in the first stage, and a second chamber configured for clamping the flange of the foundation element between the first and second clamp bodies in the second stage, further comprising a controlled non-return valve to maintain pressure in the first and/or second chamber.

18. The clamping device according to claim 4, wherein the pressure relief valve is coupled to the second chamber for reducing pressure in the second chamber to prevent said overloading of the clamping in a driving state when the foundation element is inserted into the ground.

19. A method for inserting a foundation element into the ground, the method comprising the steps of:

providing a foundation element with a flange;

providing a vibrating or hammering device with a clamping device comprising:

a frame;

a first clamp body and a second clamp body configured to enable a relative movement therebetween, wherein the first and second clamp bodies directly oppose each other, and wherein the first and second clamp bodies are provided with respective first and second clamping surfaces that are configured for engaging with respective first and second flange surfaces, positioned therebetween, in a clamping direction that substantially corresponds to a vertical direction;

a positioning drive for moving the first clamp body relative to the second clamp body in a positioning direction that substantially corresponds to a horizontal direction; and wherein the positioning direction is substantially transverse to the clamping direction;

a clamping drive for moving the first clamp body relative to the second clamp body to and/or from the flange surfaces in the clamping direction; and a pressure relief valve coupled to the clamping drive configured to prevent overloading of the clamping device in a driving state wherein the foundation element is inserted into the ground;

clamping the flange; and inserting the foundation element into the ground.

20. The method according to claim 19, further comprising the step of up-ending the foundation element.

* * * * *